US006314774B1

(12) United States Patent
Andersson

(10) Patent No.: US 6,314,774 B1
(45) Date of Patent: Nov. 13, 2001

(54) CYLINDER LOCK

(75) Inventor: Daniel Andersson, Eskilstuna (SE)

(73) Assignee: ASSA AB, Eskilstuna (SE)

( * ) Notice: Subject to any disclaimer, the term of this patent is extended or adjusted under 35 U.S.C. 154(b) by 0 days.

(21) Appl. No.: 09/485,090

(22) PCT Filed: Jul. 15, 1998

(86) PCT No.: PCT/SE98/01388

§ 371 Date: Feb. 4, 2000

§ 102(e) Date: Feb. 4, 2000

(87) PCT Pub. No.: WO99/09281

PCT Pub. Date: Feb. 25, 1999

(30) Foreign Application Priority Data

Aug. 15, 1997 (SE) ..... 9702951

(51) Int. Cl.[7] ..... E05B 27/06
(52) U.S. Cl. ..... 70/358; 70/357; 70/493
(58) Field of Search ..... 70/358, 357, 359, 70/348, 344, 419, 409, 493

(56) References Cited

U.S. PATENT DOCUMENTS 5,775,144 * 7/1998 Pagaldaz ..... 70/358
5,823,029 * 10/1998 Eden et al. ..... 70/409
5,893,785 * 4/1999 Athanassiou ..... 70/493
5,934,119 * 8/1999 Keller ..... 70/358

* cited by examiner

*Primary Examiner*—Richard M. Camby
(74) *Attorney, Agent, or Firm*—Sughrue, Mion, Zinn, Macpeak & Seas, PLLC

(57) ABSTRACT

A cylinder lock (1) comprises a cylinder housing (2), a plug (3) having a key slot (3*c*), and a driver (20). The cylinder housing (2) has a row of pin channels in a "twelve o'clock" position and a row of pin channels in a "ten o'clock" position, to enable the lock to be operated with a service key that can be inserted in the "ten o'clock" position. A cylindrical latching element (15) surrounds the inner end of the plug and moves in accompaniment with rotation of the plug as the plug is turned with a standard key (8). The latching element (15) is held fixed when the plug is rotated by means of a service key (9). The latching element is designed to co-act with means on the driver that enable the plug (3) to move axially upon transition of the "twelve o'clock" position, wen the plug is rotated by means of the service key. The latching element is held fixed in relation to the housing (2) by means of an intermediate pin (6).

8 Claims, 2 Drawing Sheets

CYLINDER LOCK

FIELD OF INVENTION

The present invention relates to a cylinder lock of the kind defined in the preamble of claim 1.

Cylinder locks of this kind enable a person that possesses a service key, e.g. the janitor of a block of rented apartments, or flats, is able to enter an apartment, but only when the owner of the apartment so permits. In this case, when the owner leaves the apartment he or she will turn the cylinder plug to the service mode and therewith enable the janitor to enter the apartment by means of a service key.

However, when the janitor leaves the apartment, he/she is unable to turn the lock cylinder to its standard mode, since the service key cannot be removed from the lock with the lock in the service mode.

A person having access to a service key is unable to enter an apartment where the lock cylinder has been left in the standard mode of the lock by the owner of the apartment as he/she leaves. Although the janitor can, as a rule, insert the key in the key slot, rotation of the cylinder plug is prevented by one or more pins located in the pin channels. However, the cylinder plug can be turned with the aid of the standard key, regardless of whether the lock is in its standard or its service mode.

DESCRIPTION OF THE BACKGROUND ART

SE,B,8307139-9 (GKN-Stenman) describes a lock of this kind in which one of the intermediate pins has a larger diameter than corresponding upper pins in the first row of pin channels, and corresponding pin channels in the cylinder plug have a flared or widened part that is able to receive an intermediate pin of larger diameter. The intermediate pin can therewith be received in the widened part of said pin channel in the cylinder plug, but is unable to enter pin channels in the cylinder housing of smaller diameter, therewith latching the service key. Although this solution is simple from a technical aspect of lock manufacture, there is a danger that the intermediate pin will wedge firmly between a widened and a narrower channel part if an attempt is made to remove the service key when the lock is in its standard mode, therewith making it impossible to return the cylinder plug to the service mode. This, in turn, totally prevents removal of the service key, whereupon it becomes necessary to break open the lock in order to open the door.

NO,A,8007660-1 (Elkem-Spigerverket) describes another arrangement in which the number of pin channels in the standard mode differs from the number of pin channels in the service mode. Withdrawal of the service key in the normal mode is prevented by virtue of corresponding lower pins being unable to move upwards in this mode. However, it is relatively easy to grind down a relevant part of the key such as to avoid the latching effect.

SE,B,8800818-0 (Publication No. 460 797) (ASSA) describes a lock according to the preamble of claim 1, in other words the lock also includes a separate latching element that assists in preventing withdrawal of the service key in the standard mode of the lock. The latching element described in this document is disposed in the region between the inner end of the cylinder plug and the drive element, and will be subjected to comparatively large stresses and strains with subsequent wear in conjunction with use, and particularly in view of the necessary slenderness of the latching element. This presents the danger of a malfunction, therewith jeopardising the reliability of the lock system as a whole. For instance, when the plug is insufficiently displaced axially there is a greater risk that one or more pins will pass unintentionally into the pin channels in the plug and therewith prevent its rotation.

OBJECTS OF THE INVENTION

An object of the present invention is to avoid the drawbacks of known cylinder locks of this particular kind.

Another object of the invention is to provide a latching element which is essentially free from stresses and strains and therewith subjected to much less wear and tear, particularly in conjunction with the use of the standard key, which is, after all, used more frequently than the service key.

Still another object of the present invention is to provide a cylinder lock where the plug can be moved axially but where such movement is avoided when using a standard key.

SUMMARY OF THE INVENTION

These and other objects of the invention are fulfilled by an inventive cylinder lock of the kind defined in the introduction and having the characteristic features set forth in the characterising clause of claim 1.

Because the latching element can be rotated together with the plug, and can also be fixed relative to the plug in the aforesaid manner, the latching element will not be subjected to heavy strain when carrying out its intended function as the lock is turned by means of the service key. The latching element can also be given a comparatively robust and reliable construction and need not therefore be subjected to any form of wear that will jeopardise its function, even after a long time in use.

This essentially eliminates the risk of the plug not being displaced during passage of the standard mode under the action of the service key, which could result in unintentional blocking of the pin channels in the plug and destruction of the entire locking function.

It is preferred in practice that the latching element will be held fixed when withdrawing the standard key in the service mode and that said element is kept fixed after inserting the service key and turning the plug by means of this key.

The plug can thus be rotated readily from the service mode by means of the service key while the latching element is held in its fixed position. Axial displacement of the plug in conjunction with the passage of the standard mode therewith takes place with the latching element in said fixed position. When the plug is turned by means of the standard key, the latching element will, instead, accompany this movement and the plug will not therefore move axially.

The latching element is preferably held fixed by a pin, suitably an intermediate pin, that has a part that enters into the second row of pin channels. Thus, when the service key is inserted into the lock with the lock in its service mode, the parting line will lie between the plug and the latching element. On the other hand, when a standard key is inserted into a lock with the lock in its service mode, a parting line will lie between the outside of the latching element and the surrounding housing, i.e. the latching element can be rotated together with the plug by means of a pin, suitably an intermediate pin, hose one end enters the pin channel in the plug.

According to the invention, the latching element is also adapted to co-act with the driver so as to enable the plug and the driver to move axially as the plug is rotated by the service key and then passes the standard mode.

According to one embodiment preferred in practice, the latching element is preferably a generally cylindrical element which surrounds the inner end of the plug either completely or partially and which includes a radially extending hole that functions as a pin channel, so as to allow a pin in a corresponding pin channel in the housing and the core, respectively, to move in a radial direction.

The latching element may be provided at its inner end with a flange collar and/or one or more axially facing devices, for instance a recess or notches, for co-action with corresponding axially extending driver-mounted devices, for instance projections or nips, such that the plug and the driver can move axially relative to the latching element in a certain position of rotation of said plug and said driver and are returned to their initial position in another position of rotation.

The plug and the latching element may also include mutually co-acting devices, such as pins or beads, which cause the plug to move axially in conjunction with its passage of the standard mode when rotated by the service key.

Further characteristic features of the invention and advantages afforded thereby will be apparent from the following description of a preferred embodiment given with reference to the accompanying drawings.

BRIEF DESCRIPTION OF THE FIGURES IN THE DRAWINGS

DETAILED DESCRIPTION OF A PREFERRED EMBODIMENT

A cylinder lock 1 is comprised of a cylinder housing 2 that accommodates a rotatable cylinder plug 3. The cylinder housing includes two rows of pin channels, of which one row corresponds to the standard mode of the plug 3 (the twelve o'clock mode) and the other row corresponds to the service mode of said plug (the "ten o'clock" mode).

Figure 1:
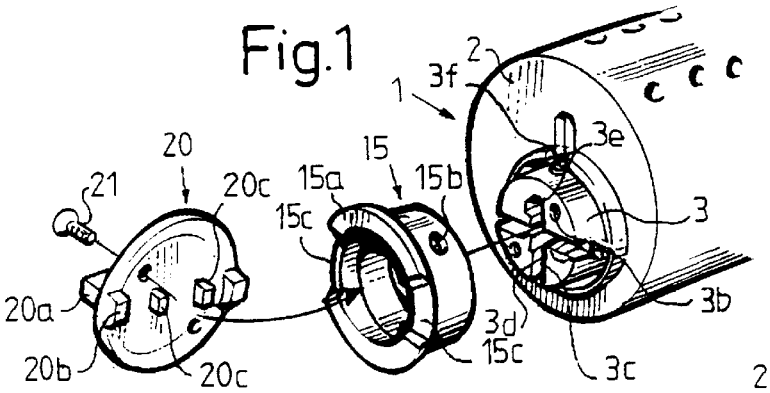
FIG. 1 is a perspective, exploded view of one end of an inventive cylinder lock and associated plug, together with a driver and a latching element in accordance with the invention.

The standard mode is shown in FIG. 1 and its pin channels are referenced 2*a* and accommodate upper pins 4 that are actuated by springs 10. The upper pins 4 have a certain configuration that can be varied with the intention of making it difficult to force the lock, and can also have mutually different properties. For instance, some of the pins may include hardened cores so as to make drilling difficult.

The cylinder plug 3 includes a row of pin channels 3*a* that accommodate bottom pins 5, which may have varying configurations and properties similar to the upper pins 4. The cylinder plug has a key slot 3*c*.

Figure 3:
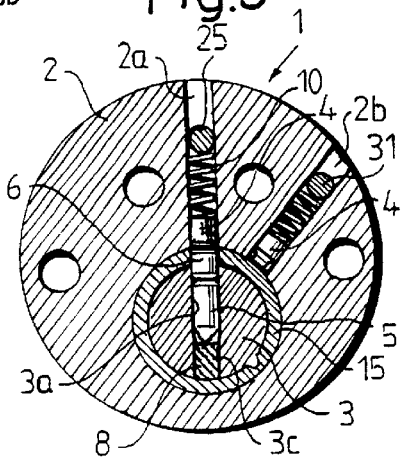
FIG. 3 is a sectional view taken on the line III—III in FIG. 2.
Figure 4:
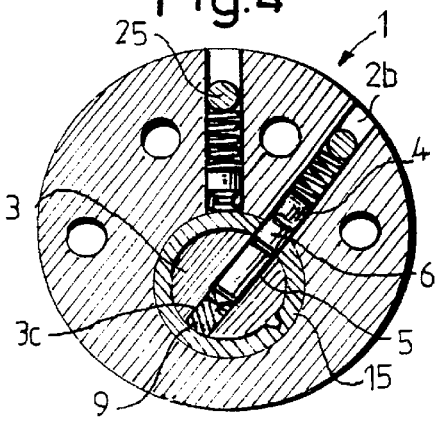
FIG. 4 is a view corresponding to that of FIG. 3 and shows the plug after having been turned by means of the standard key to a "ten o'clock" position, the removal of the standard key and the insertion of a service key in this state of the lock.

The cylinder housing 2 also includes a second row of pin channels, referenced 2*b,* as shown in FIGS. 3 and 4.

The pin channels 2*a* are outwardly delimited in the cylinder housing by "stopper elements", e.g. in the form of screws 25, against which the springs 10 rest.

As will be seen from FIGS. 2 and 3, in addition to accommodating upper pins 4 and lower pins 5, the innermost pin channel also accommodates an intermediate pin 6, the function of which will be described in more detail hereinafter. The thickness of the intermediate pin is slightly-larger than the radial wall-thickness of a latching element 15 belonging to the cylinder lock, as shown more clearly in FIG. 1. The latching element 15 is generally cylindrical in shape and has, but not necessarily, a flange collar 15*a* at its inner end. It also includes a radial hole 15*b* which functions as a channel for the intermediate pin 6.

Figure 2:
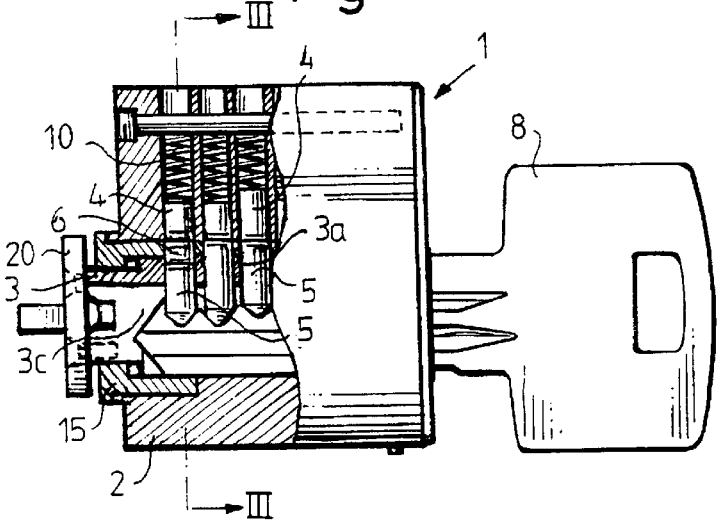
FIG. 2 is a partially cut-away side view of a cylinder lock according to FIG. 1 with its component parts mounted in position and with a standard key inserted in the standard mode of the lock.
Figure 5:
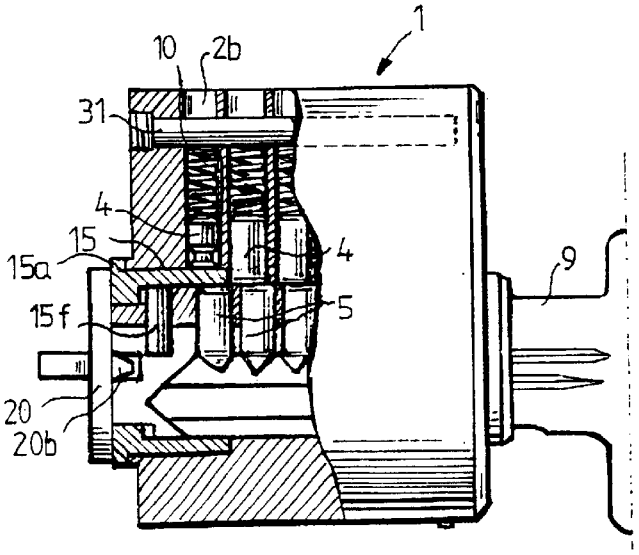
FIG. 5 is a partially cut-away side view of the cylinder lock after having turned the plug by means of the service key to the standard mode of the lock (the "twelve o'clock" position) and axial movement of the plug to the right as seen in the Figure).
Figure 6:
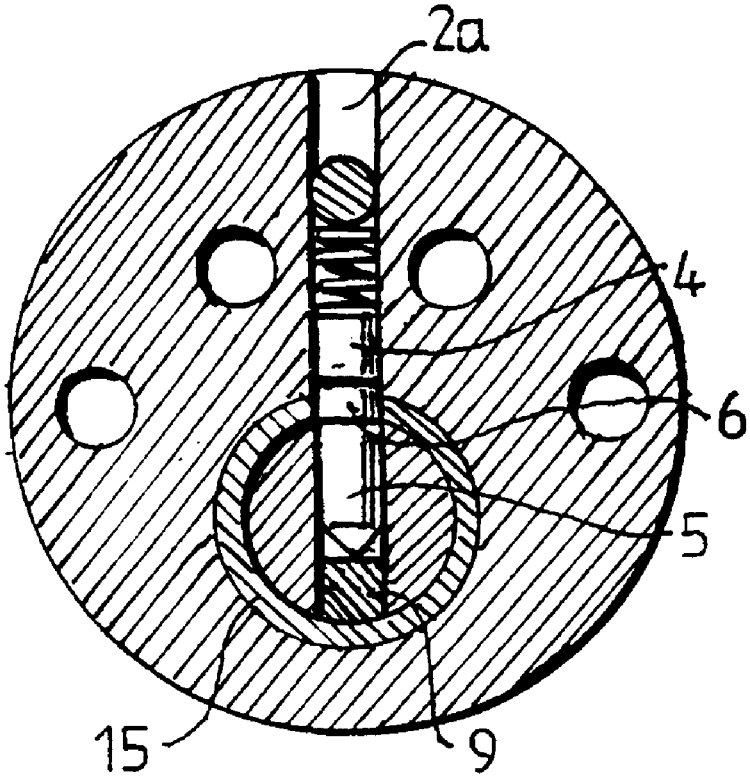
FIG. 6 is a cross-sectional view taken on the line VI—VI in FIG. 5.

As evident from FIGS. 1, 2 and 5, the plug 3 co-acts typically with a driver 20 connected to the plug by means of screws 21 received in screw holes 3*b*.

Figure 7:
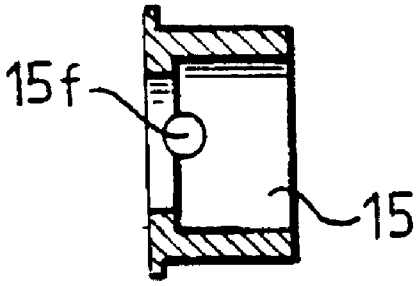
FIG. 7 is an upwardly directed horizontal sectional view through the latching element, showing, among other things, its displacement pin adapted for co-action with a corresponding displacement pin provided on the inner end of the plug.

That side of the driver 20 which lies proximal to the plug 3 is provided with peripheral projections or nips 20*b* that co-act with recesses or notches 15*c* on the flange 15*a* of the latching element in a manner described below, and pins 20*c* which enter grooves 3*d,* 3*e* in the inner end surface of the plug 3. Displacement pins 3*f,* 15*f* in the plug and the latching element, respectively, shown in FIGS. 1 and 7 among others, cause the plug to move axially during transition of the lock from its standard "twelve o'clock" mode in response to turning the plug by means of the service key 9.

If the key is not inserted in the plug, the plug will normally be latched against rotation in both the standard and service modes, by the pins.

When a standard key (FIGS. 2 and 3) is inserted in the plug, the plug can be rotated to carry out a locking function in a normal way. In this respect, the latching element 15 will accompany the rotary movement of the plug. The coupling between plug 3 and latching element 15 is achieved by the intermediate pin 6 in the inner pin channel, more particularly by virtue of the engagement of part of this intermediate pin 6 in the pin channel 3*a* in the plug. The parting plane between the intermediate pin 6 and the upper pin 4 thus lies at the interface between the latching element 15 and the cylinder housing 2.

The aforedescribed is also shown in the cross-sectional view of FIG. 3, i.e. said Figure shows the plug 3 in its standard or "twelve o'clock" mode and the intermediate pin 6 coupling the plug 3 to the latching element 15.

FIG. 3 also shows the presence of a further pin channel referenced 2*b,* at an angle to the pin channel 2*a*. This pin channel is located in the service mode or "ten o'clock" mode, in which mode the standard key can be withdrawn and a service key 9 inserted instead by service personnel or some other person given the opportunity to enter the apartment.

FIG. 4 shows the situation where such a service key 9 has been inserted in the service mode, therewith having moved the intermediate pin 6 up into the pin channel 2*b,* so that the intermediate pin will hold the latching element 15 immovable in relation to the cylinder housing 2. The plug 3, however, can be turned by means of the service key 9, since there has now been formed instead a parting plane between the inner mantle surface of the latching element 15 and the peripheral surface of the plug 3, by an interface between intermediate pin 6 and lower pin 5.

As will be seen from FIG. 5, as the plug 2 is rotated by means of the service key 9 the plug will be moved axially through the medium of said displacement pins 3*f,* 15*f,* during its passage of the standard mode or "twelve o'clock" mode. The latching element 15 still remains in the position shown in FIG. 4, in which it is held fixed relative to the housing 3 by means of the intermediate pin 6. Axial movement between the driver 20 and the latching element 15 is permitted during said passage of the "twelve o'clock" mode, by virtue of the ability of the projections or nips 20*b* on the inner surface of the driver 20 to enter the recesses 15*c* in the flange 15*a* of the latching element 15. Pins 20*a* are able to enter respective grooves 3*d,* 3*e,* in the end surface of the plug 3 at the same time.

As the plug and the driver continue to rotate, bevelled side surfaces on the projection 20*b* will co-act with corresponding bevelled surfaces on the flange 15*a,* so as to move the driver and the plug axially, this time to the left in the Figure, i.e. to the starting position shown in FIG. 1.

Thus, axial displacement of the plug and the driver to the right takes place solely during passage of the "twelve o'clock" mode, i.e. when there may be a risk of upper pins in the cylinder housing unintentionally entering a pin channel in the core and therewith blocking the lock function. Axial displacement of the plug removes this risk.

In parallel herewith, the latching element 15 contributes towards preventing withdrawal of the service key in the "twelve o'clock" mode, by virtue of the fact that when attempting to withdraw the service key, the left lower pin 5 will strike against the inner surface of the latching element. Furthermore, the fact that the plug has moved to the right makes upward movement of remaining lower pins into respective pin channels 2*b* in the cylinder housing impossible.

Subsequent to having rotated the plug through one turn by means of the service key, said key can be removed from the lock in the service mode or "ten o'clock" mode. When the owner of the apartment, or flat, returns, he/she can insert his/her standard key, and the lock will function in the normal manner, i.e. the plug is not displaced when passing the "twelve o'clock" mode.

It will be obvious from the above description that the latching element 15 will only be subjected to the slightest strain when the plug is rotated with a standard key or service key. This enables the latching element 15 to be given a robust nature with which there is little risk of any appreciable wear, thereby imparting to said latching element a length of useful life that corresponds to the length of useful life of the cylinder lock in its entirety. Because the latching element is retained in a fixed position relative to the cylinder housing in conjunction with removing the standard key in the service mode in the manner described, the latching element is able to execute its intended function without being affected by unfavourable external forces, and thereafter again become active in accompanying rotary movement of the plug when the standard key is re-inserted.

What is claimed is:

1. A cylinder lock which includes a cylinder plug (3) that is coupled to a driver (20) and rotatably accommodated in a cylinder housing (2), and that includes a key slot (3*c*) and a row of pin channels (3*a*) that accommodate a row of pins (5) and co-act with at least two rows of pin channels (2*a,* 2*b*) which accommodate pins (4, 5, 6) provided in the cylinder housing (2) and actuated by springs (10), namely a first row of pin channels (2*a*) corresponding to a standard mode in which a standard key (8) can be inserted into and rotate the plug (3), and a second row of pin channels (2*b*) that are angled to said first row and correspond to a service mode, wherein one or more of which pin channels (2*b*) also accommodate an intermediate pin (6) in addition to upper pins (4), wherein subsequent to insertion of a service key (9) in the service mode, the plug (3) can be moved axially from an initial position (position I) to a displacement position (position II) by turning said key, in which latter position the plug-carried pin channels (3*a*) are located out of line with pin channels (2*a,* 2*b*) in the cylinder housing, and wherein a latching element (15) contributes towards preventing withdrawal of the service key (9) in the standard mode, characterised in that the latching element (15) can be rotated together with the plug (3) by means of the standard key and can also be fixed in a position taken in conjunction with said rotation; and in that the plug can be rotated from this position and displaced axially relative to said latching element by means of the service key (9).

2. A cylinder lock according to claim 1, characterised in that the latching element (15) is held fixed when withdrawing the standard key (8) in the service mode and is held fixed after insertion of the service key (9) and rotation of the plug (3).

3. A cylinder lock according to claim 2, characterised in that the latching element (15) is held fixed by a pin in a channel in the second row of pin channels (2*b*).

4. A cylinder lock according to 3, characterised in that the latching element (15) is held fixed by an intermediate pin (6) when rotating the plug with a service key.

5. A cylinder lock according to claim 1, characterised in that the latching element (15) is also adapted to co-act with the driver (20) so as to enable the plug (3) and the driver (20) to be moved axially when rotating the plug with the service key during its passage of the standard mode.

6. A cylinder lock according to claim 1, characterised in that the latching element is preferably a generally cylindrical element (15) which surrounds the inner end of the plug (3) either completely or partially and which includes a radial hole (15*b*) that serves as a pin channel and that permits a pin, preferably an intermediate pin (6) to move radially in a pin channel in the housing and in the plug that lies in line with said intermediate pin.

7. A cylinder lock according to claim 6, characterised in that the inner end of the latching element (15) carries a flange collar (15*a*) and/or one or more axially facing devices, e.g. recesses or notches (15*b*), for co-action with corresponding axially extending devices, e.g. projections or nips, (20*b*) on the driver (20), so as to enable the plug and the driver to be moved axially in one rotational position of the plug and to return to their initial state in another rotational position of said plug and said element.

8. A cylinder lock according to claim 1, characterised in that the plug (3) and the latching element (15) include mutually co-acting devices, e.g. pins (3*f,* 15*f*) or beads, which function to move the plug axially when said plug is rotated by the service key (9) in connection with its passage of the standard mode.

* * * * *